US008397457B2

(12) United States Patent
Hauser

(10) Patent No.: US 8,397,457 B2
(45) Date of Patent: Mar. 19, 2013

(54) METHOD FOR ATTACHING A REINFORCEMENT OR FACING ON AN EXISTING STRUCTURAL COMPONENT AND STRUCTURAL COMPONENT WITH ATTACHED REINFORCEMENT OR FACING

(76) Inventor: Stephan Hauser, Langen (DE)

( * ) Notice: Subject to any disclaimer, the term of this patent is extended or adjusted under 35 U.S.C. 154(b) by 516 days.

(21) Appl. No.: 12/605,322

(22) Filed: Oct. 24, 2009

(65) Prior Publication Data

US 2010/0107537 A1 May 6, 2010

(30) Foreign Application Priority Data

Oct. 30, 2008 (DE) ..... 10 2008 053 978

(51) Int. Cl.
*E04B 9/00* (2006.01)
*E04C 1/40* (2006.01)

(52) U.S. Cl. ..... 52/344; 52/351; 52/454; 52/506.05; 52/513

(58) Field of Classification Search ..... 52/344, 52/351, 361, 362, 363, 378, 379, 421, 425, 52/428, 432, 506.05, 507, 511, 513, 514.5, 52/515, 742.13, 742.14, 454, 506.06, 741.1
See application file for complete search history.

(56) References Cited

U.S. PATENT DOCUMENTS

| | | | | | |
|---|---|---|---|---|---|
| 824,823 | A | * | 7/1906 | Schachner | 52/289 |
| 1,697,760 | A | * | 1/1929 | Foans | 52/508 |
| 1,763,264 | A | * | 6/1930 | Shanks | 52/362 |
| 1,925,774 | A | * | 9/1933 | Phillips | 52/346 |
| 1,930,024 | A | * | 10/1933 | Varden | 52/98 |
| 2,006,635 | A | * | 7/1935 | Farr | 52/314 |
| 2,019,236 | A | * | 10/1935 | Richter | 52/127.3 |
| 2,669,114 | A | * | 2/1954 | Mills | 52/454 |
| 3,142,938 | A | * | 8/1964 | Eberhardt | 52/385 |
| 3,350,827 | A | * | 11/1967 | Sugar | 52/309.3 |
| 3,726,950 | A | * | 4/1973 | Turzillo | 264/32 |
| 4,987,719 | A | * | 1/1991 | Goodson, Jr. | 52/742.14 |
| 5,398,473 | A | * | 3/1995 | Chan | 52/506.06 |
| 5,673,529 | A | * | 10/1997 | Treister et al. | 52/511 |
| 6,807,786 | B1 | * | 10/2004 | Peck | 52/514.5 |
| 6,857,248 | B2 | * | 2/2005 | Ouellet et al. | 52/745.06 |
| 6,955,015 | B2 | * | 10/2005 | Manthei | 52/223.7 |
| 7,997,039 | B2 | * | 8/2011 | Wolf et al. | 52/314 |

FOREIGN PATENT DOCUMENTS

| | | | |
|---|---|---|---|
| DE | 19903304 | A1 | 8/2000 |
| EP | 59466 | A1 * | 9/1982 |

OTHER PUBLICATIONS (no author noted) proceedings 13. Kassler Baubetriebsseminar—Zankapfel Sichtbeton, baumaschinendienst, vol. Nov. 2003, pp. 26-28, 30-36.

* cited by examiner

*Primary Examiner* — Brian Glessner
*Assistant Examiner* — Joseph J Sadlon
(74) *Attorney, Agent, or Firm* — Gudrun E. Huckett

(57) ABSTRACT

In a method for connecting a reinforcement or facing of hydraulic-setting material of cement mortar mixture or concrete mixture on a structural component, a multi-layer reinforcement mat is attached to a structural component. A smoothing cement of hydraulic-setting material is filled into outer fabric layers of the reinforcement mat. The smoothing cement is allowed to set to form a substitute formwork. Into the space between the substitute formwork and the structural component a flowable cement mortar mixture or concrete mixture is filled in.

11 Claims, 5 Drawing Sheets

METHOD FOR ATTACHING A REINFORCEMENT OR FACING ON AN EXISTING STRUCTURAL COMPONENT AND STRUCTURAL COMPONENT WITH ATTACHED REINFORCEMENT OR FACING

BACKGROUND OF THE INVENTION

The invention relates to a method for attaching a reinforcement or facing comprised of hydraulic-setting material of cement mortar or concrete mixture on a structural component in that to the structural component a multi-layer reinforcement mat is attached and formwork is provided and into the space between formwork and the structural component flowable cement mortar mixture or concrete mixture is filled.

Such a method is disclosed in the journal "Baumaschinendienst", volume November/2003, pp. 26-28 and 30-56.

SUMMARY OF THE INVENTION

It is an object of the present invention to eliminate such formwork for attaching a reinforcement or facing on a structural component that is in particular comprised of concrete.

In accordance with the present invention, this is achieved in that a substitute formwork is integrally formed by introducing into the outer fabric layers of the reinforcement mat a smoothing cement of hydraulic-setting material and allowing it to harden or set before filling in the cement mortar mixture or concrete mixture.

Filling can be done preferably by pumping/injecting, or by pouring the cement mortar mixture or concrete mixture. Onto the outer skin comprised of the smoothing cement subsequently plaster can be applied, as usual.

The reinforcement mat is resting flat immediately on the structural component or the reinforcement mat is connected to the structural component at a spacing from a surface of the structural component.

The reinforcement mat comprises at least three fabric layers (wiremesh layers) that are each comprised of wire with a wire diameter in a range of 0.5 to 3.5 mm. The fabric layers have a mesh size of 2 mm to 60 mm, respectively. The fabric layers may differ from one another with respect to wire diameter and mesh size.

The smoothing cement is infiltrated into the outer fabric layers through a hose by applying pressure.

The smoothing cement contains fibers, preferably plastic fibers.

The reinforcement mat is attached by mechanical anchoring elements on the structural component.

The smoothing cement has a stiff consistency and a minimal flow table value. The flow table value of the smoothing cement is in the range of approximately 40% to 60% of the flow table value of the cement mortar mixture or concrete mixture that is filled into the space between the substitute formwork and the structural component.

The structural component product according to the invention, in particular structural concrete component product, is provided with a reinforcement or facing comprised of a multi-layer reinforcement mat and hydraulic-set material of a cement mortar mixture or concrete mixture, wherein the reinforcement or facing is comprised of:

an outer skin that is positioned at a spacing relative to the structural component and is formed from a hydraulic-set smoothing cement comprised of a cement mortar mixture or concrete mixture introduced into the outer fabric layers of the reinforcement mat; and an intermediate layer filling the intermediate space between the outer skin and the structural component and comprised of set cement mortar mixture or concrete mixture;

wherein the smoothing cement of the outer skin is produced from a cement mortar mixture or concrete mixture with relatively stiff consistency and relatively minimal flow value (flow table value) that is within the range of approximately 40% to 60%, preferably approximately 50%, of the flow table value of the cement mortar mixture or concrete mixture filled into the intermediate space between the outer skin and the structural component.

In the structural component product the reinforcement mat is attached flat immediately on the structural component. In the alternative, the reinforcement mat may be connected to the structural component at a spacing from a surface of the structural component.

The reinforcement mat of the structural component product is comprised of at least three fabric layers comprised of wire with wire diameter in a range of 0.5 to 3.5 mm, wherein the fabric layers have a mesh size of 2 mm to 60 mm, respectively.

The fabric layers of the reinforcement mat may differ from one another with respect to wire diameter and mesh size.

The outer skin of the reinforcement or facing contains fibers, preferably plastic fibers.

The structural component product comprises mechanical anchoring elements that secure the reinforcement mat on the structural component.

The reinforcement mat of the structural component product is comprised of outer fabric layers integrated into the outer skin and inner fabric layers integrated into the intermediate layer, wherein the outer fabric layers are comprised of wire having a wire diameter that is smaller than a wire diameter of the wire of the inner fabric layers and wherein a mesh size of the outer fabric layers is smaller than a mesh size of the inner fabric layers.

The reinforcement mat is comprised of at least 5 fabric layers, preferably up to 20 fabric layers.

The smoothing cement of the outer skin is a smoothing mortar.

The invention will be explained in the following with the aid of FIGS. 1 to 5 illustrating various reinforcement and facing structures.

DESCRIPTION OF THE PREFERRED EMBODIMENTS

Figure 1:
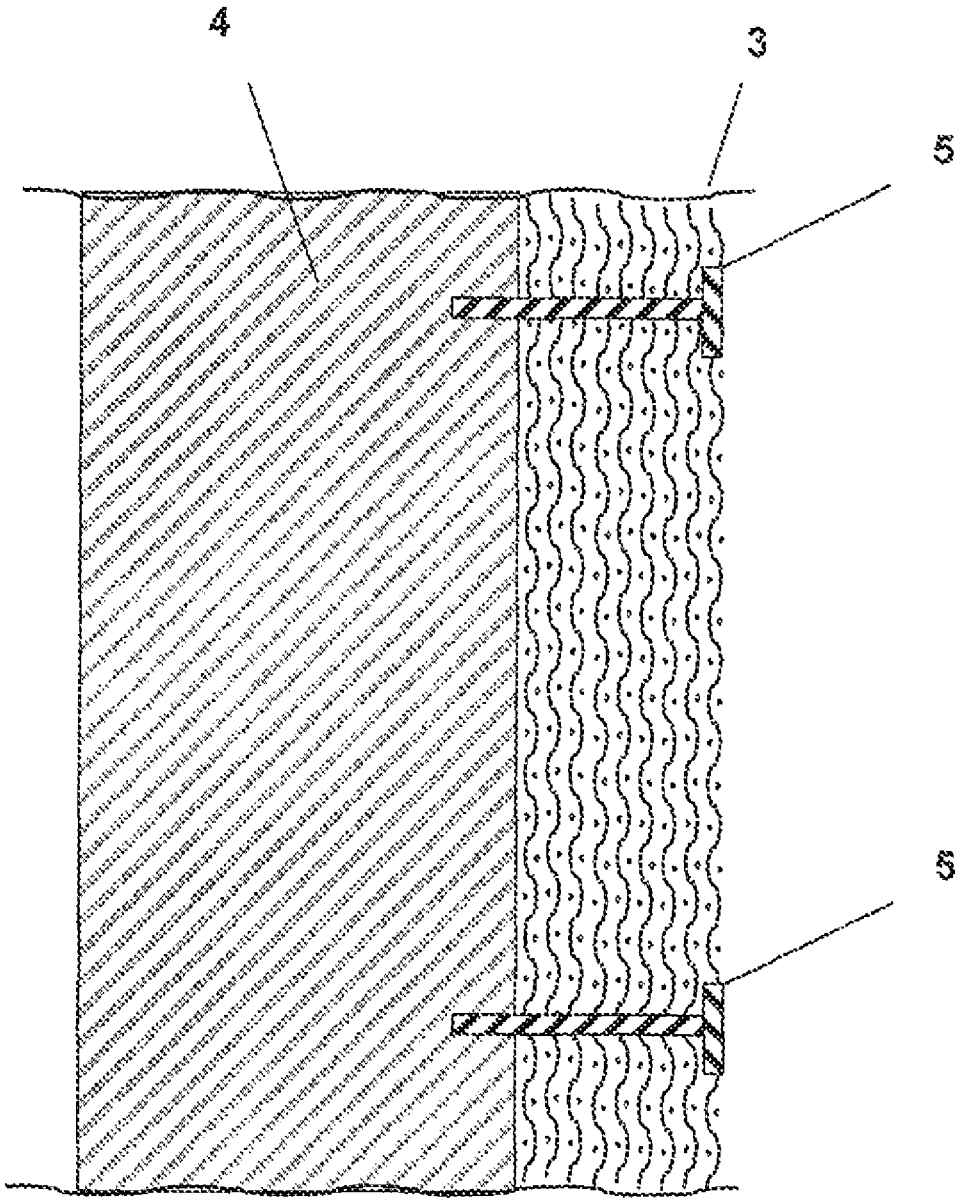
FIG. 1 is a schematic section view of a structural component and multi-layer reinforcement mat anchored thereto.
Figure 5:
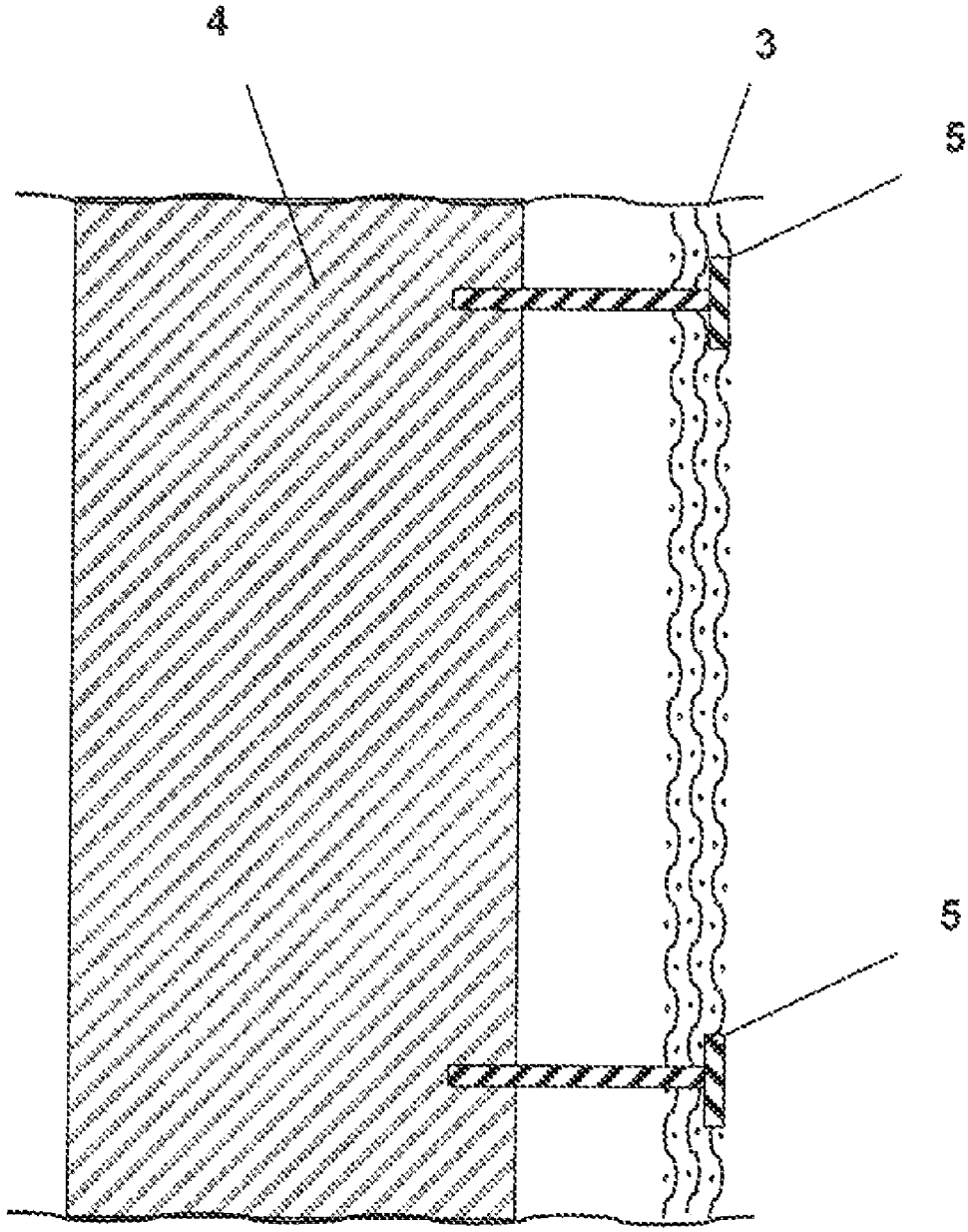
FIG. 5 is a schematic section view of a structural component and a multi-layer reinforcement mat where the reinforcement is spaced from the structural component

In a first step according to FIG. 1 on the existing structural component 4 a reinforcement mat 3 that comprises several, at least three, preferably five and up to 20 or even more, fabric layers with wire thickness or diameter in the range of 0.5 mm to 3.5 mm and mesh size in the range of 2 mm to 60 mm is attached, either so as to rest flat on the surface (see FIG. 1) or at a spacing from the surface of the structural component 4 (see FIG. 5).

Figure 2:
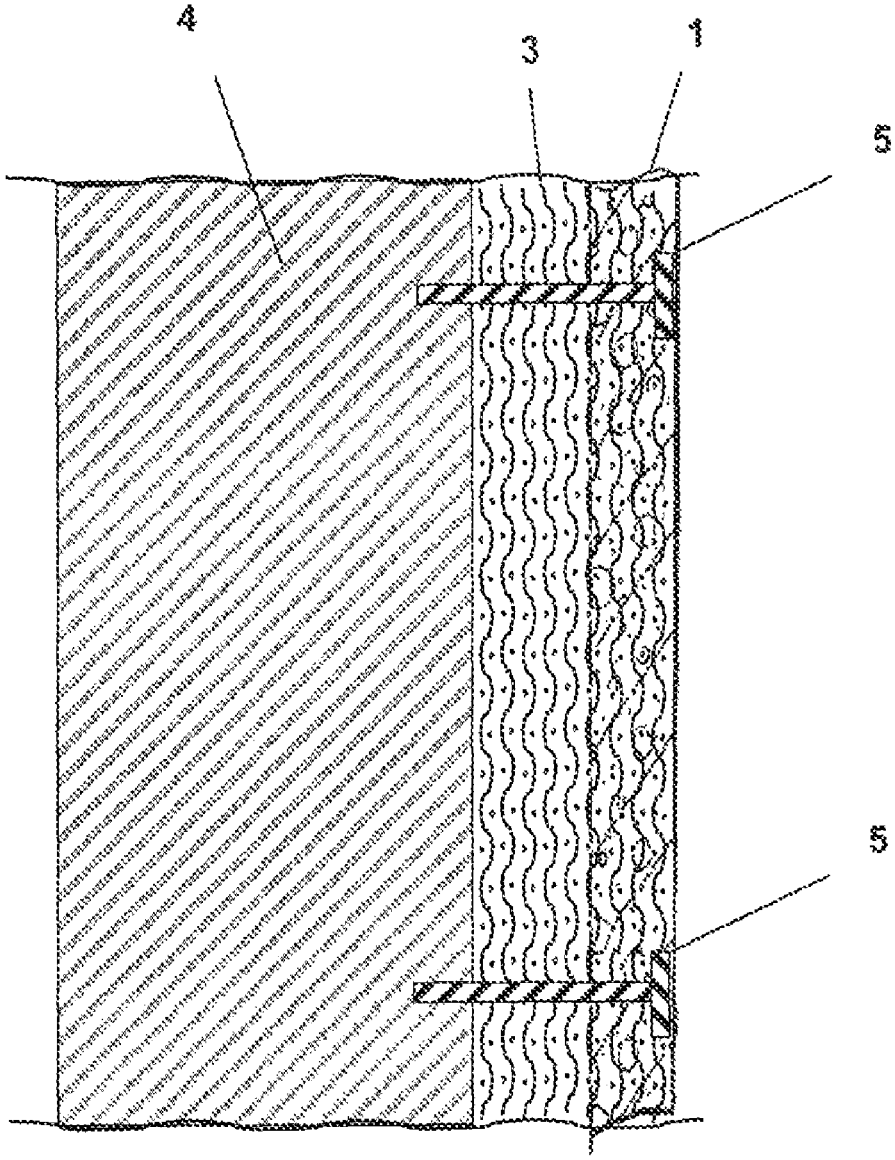
FIG. 2 is a schematic section view of the structural component and multi-layer reinforcement mat of FIG. 1 showing the smoothing cement filled into the outer fabric layers and forming a substitute formwork.
Figure 3:
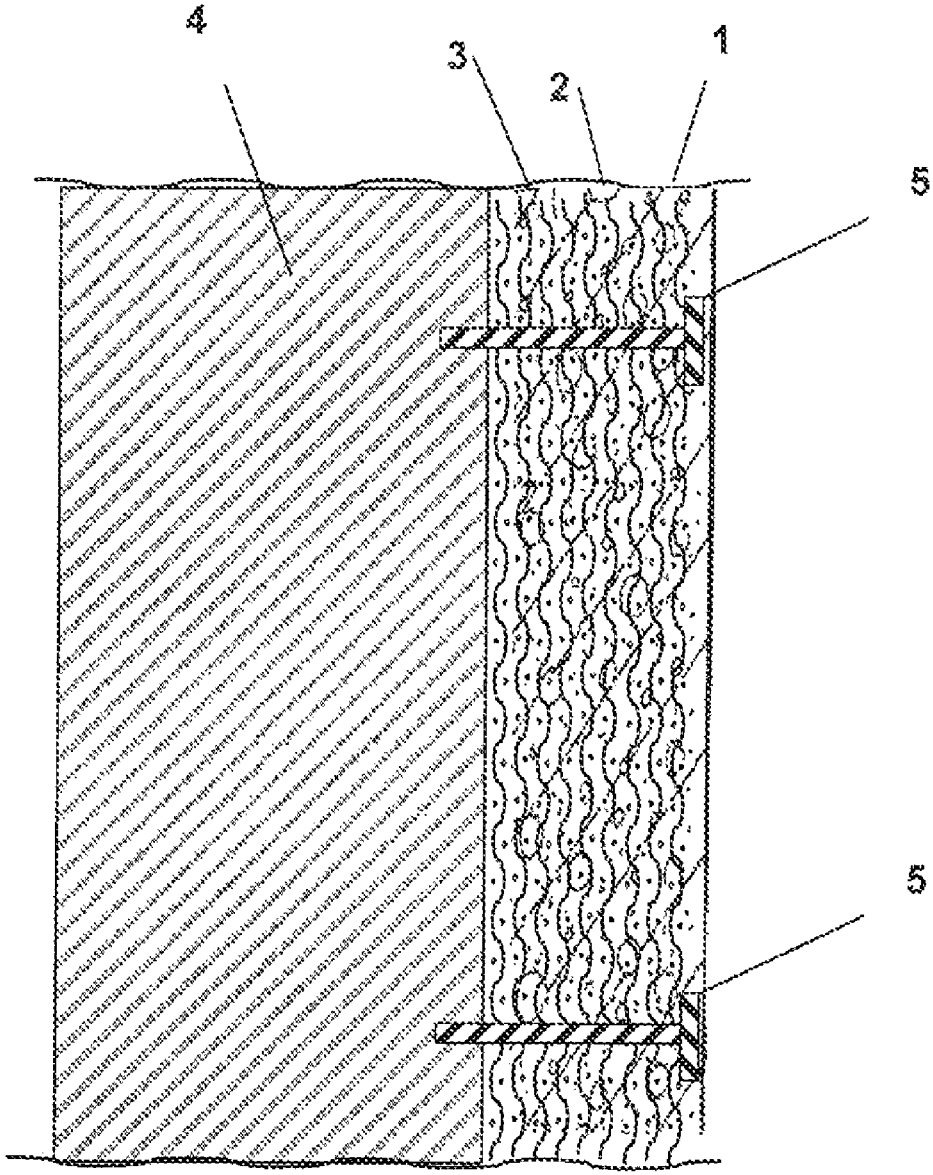
FIG. 3 is a schematic section view of the structural component and multi-layer reinforcement mat with substitute formwork and intermediate space being filled with cement mortar mixture or cement mixture.

Into the outer fabric layers of the reinforcement mat 3 in a second step according to FIG. 2 a smoothing cement, preferably a smoothing mortar, of hydraulic-setting material of a cement mortar mixture or concrete mixture is introduced by pressing or infiltration by means of a hose. This smoothing cement is allowed to set until a rigid outer skin is formed so that a substitute formwork 1 is produced. Into the intermediate space between this substitute formwork 1 and the structural component 4 subsequently, according to FIG. 3, a cement mortar mixture or concrete mixture 2 that preferably contains aggregates is introduced by pumping or injecting or by pouring. The outer skin can subsequently be plastered, if desired. The fabric layers that are integrated into the outer skin have preferably a reduced wire thickness (diameter) and mesh size than the inwardly positioned fabric layers.

The method according to the invention makes it possible to provide in particular vertical or slantedly positioned structural components with an outer reinforcement or facing, for example, comprised of a micro-reinforced high-performance concrete without employing e.g. steel formwork. By attaching the reinforcement mat, subsequently applying the smoothing cement, and then filling cement mortar mixture or concrete mixture into the intermediate space, a method for attaching a reinforcement or facing on an existing structural component is provided that in comparison to conventional formwork methods is much simpler.

The smoothing cement that is used according to the invention is substantially stiff and differs with regard to its consistency from the substantially flowable hydraulic-setting material that is filled into the space between the outer skin or substitute formwork and the existing structural component. The consistency is defined by the so-called flow table value (result of flow table test) that is a characteristic for the flowing properties. According to the invention, a smoothing cement is used preferably whose flow table value is in the range of approximately 50% of that of the flowable material filled into the space between the in situ substitute formwork and the structural component.

By using a smoothing cement that contains fibers, in particular plastic fibers, as a filler, the processability of the smoothing cement is improved and also an additional positive effect by enhancing the fire protection properties of the outer skin is observed.

As a filler, basically any material can be used in order to fulfill much different requirements.

The reinforcement mat 3 is preferably attached by means of mechanical anchoring elements 5 to the component 4.

Figure 4:
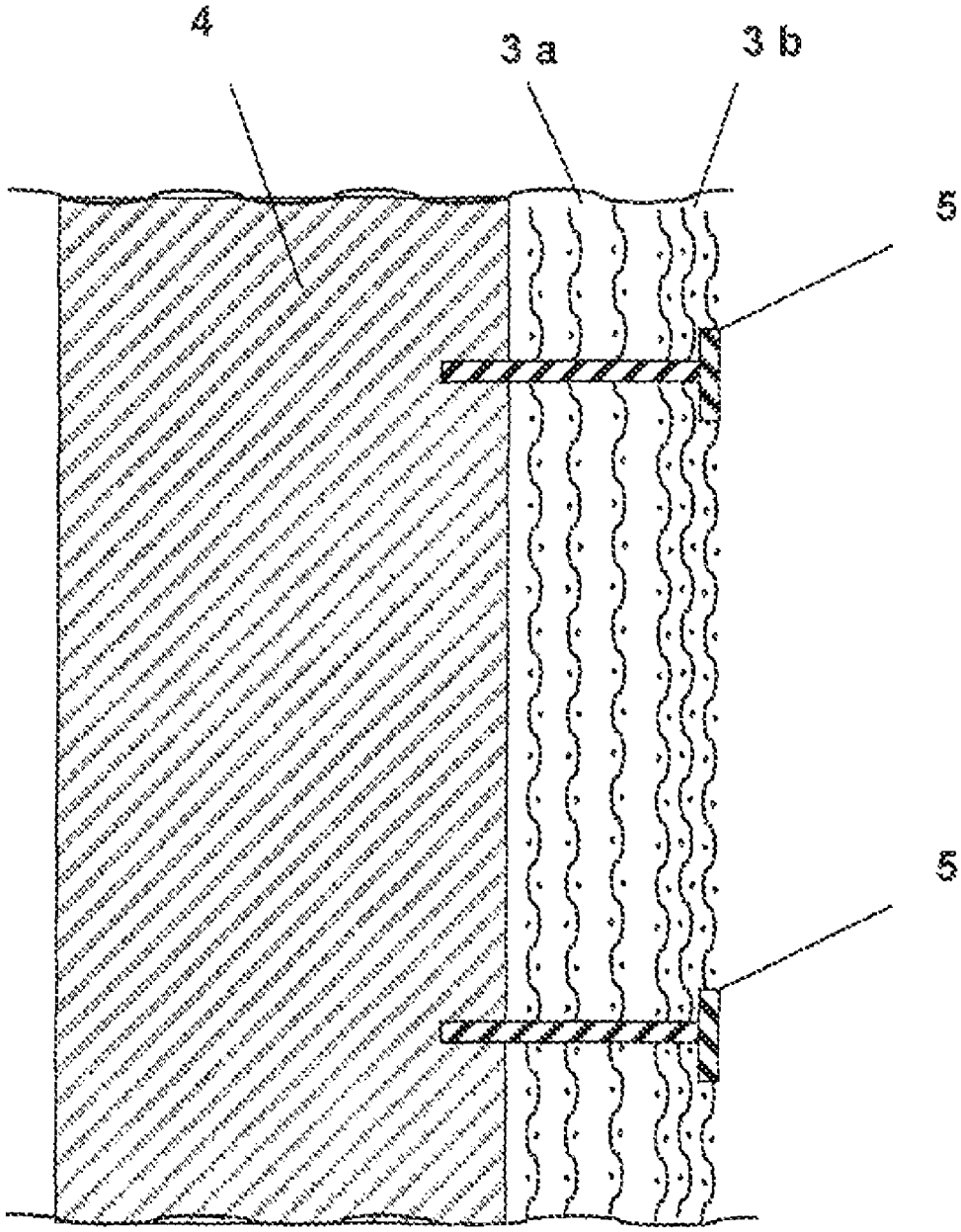
FIG. 4 is a schematic section view of a structural component and a multi-layer reinforcement mat that is comprised of different fabric layers.

According to FIG. 4 the reinforcement mat 3 is preferably comprised of layers 3*a*, 3*b* that differ from one another with respect to wire thickness (diameter) and mesh size, respectively.

According to FIG. 5 the reinforcement mat 3 is positioned at a spacing from the structural component 1.

The method according to the invention is preferably suitable for reinforcing already existing structural components in the form of supports or columns, walls, containers, ceilings, in particular the downwardly facing ceiling surfaces.

The specification incorporates by reference the entire disclosure of German priority document 10 2008 053 978.3 having a filing date of Oct. 30, 2008.

While specific embodiments of the invention have been shown and described in detail to illustrate the inventive principles, it will be understood that the invention may be embodied otherwise without departing from such principles.

What is claimed is:

1. A structural component product comprising:

a structural component;

a reinforcement or facing attached to the structural component and comprised of a multi-layer reinforcement mat comprised of fabric layers and a hydraulic-set material of cement mortar mixture or concrete mixture;

wherein the reinforcement or facing comprises an outer skin positioned at a spacing from the structural component so that between the outer skin and the structural component a space is defined, wherein the outer skin is comprised of at least some of said fabric layers as outer fabric layers and a hydraulic-set smoothing cement filled into said outer fabric layers of the reinforcement mat, said outer fabric layers being embedded in the hydraulic-set smoothing cement;

wherein the reinforcement or facing further comprises an intermediate layer of set cement mortar mixture or concrete mixture that fills completely said space between the outer skin and the structural component;

wherein the smoothing cement of the outer skin is made from a cement mortar mixture or concrete mixture with stiff consistency and minimal flow table value, that is in the range of approximately 40% to 60% of a flow table value of the cement mortar mixture or concrete mixture that has been filled into the space between the outer skin and the structural component to form the intermediate layer.

2. The structural component product according to claim 1, wherein the reinforcement mat is attached flat immediately on the structural component.

3. The structural component product according to claim 1, wherein the reinforcement mat is connected to the structural component at a spacing from a surface of the structural component.

4. The structural component product according to claim 1, wherein the reinforcement mat is comprised of at least three of said fabric layers comprised of wire with wire diameter in a range of 0.5 to 3.5 mm, wherein said fabric layers have a mesh size of 2 mm to 60 mm, respectively.

5. The structural component product according to claim 4, wherein said fabric layers differ from one another with respect to wire diameter and mesh size.

6. The structural component product according to claim 1, wherein the hydraulic-set smoothing cement of the outer skin contains fibers, preferably plastic fibers.

7. The structural component product according to claim 1, comprising mechanical anchoring elements that secure the reinforcement mat on the structural component.

8. The structural component product according to claim 1, wherein the intermediate layer comprises several of said fabric layers as inner fabric layers, wherein said outer fabric layers are comprised of wire having a wire diameter that is smaller than a wire diameter of the wire of said inner fabric layers and wherein a mesh size of said outer fabric layers is smaller than a mesh size of said inner fabric layers.

9. The structural component product according to claim 1, wherein the reinforcement mat is comprised of at least 5 of said fabric layers.

10. The structural component product according to claim 1, wherein the reinforcement mat is comprised of up to 20 of said fabric layers.

11. The structural component product according to claim 1, wherein the smoothing cement is a smoothing mortar.

* * * * *